US005264904A

United States Patent [19]

Audi et al.

[11] Patent Number: 5,264,904

[45] Date of Patent: Nov. 23, 1993

[54] HIGH RELIABILITY BLADE CLEANER SYSTEM

[75] Inventors: Anthony E. Audi, Rochester; Ronald E. Godlove, Bergen; N. Kedarnath, Fairport; Clark V. Lange; Nero R. Lindblad, both of Ontario; Alvin J. Owens, Jr.; Darryl L. Pozzanghera, both of Rochester; Herbert C. Relyea; Bruce E. Thayer, both of Webster, all of N.Y.

[73] Assignee: Xerox Corporation, Stamford, Conn.

[21] Appl. No.: 914,401

[22] Filed: Jul. 17, 1992

[51] Int. Cl.[5] ..... G03G 21/00

[52] U.S. Cl. ..... 355/299; 15/256.5; 355/205; 355/207; 355/297; 355/302

[58] Field of Search ..... 355/296-301, 355/205, 207, 302, 307; 15/256.5, 256.51, 256.52

[56] References Cited

U.S. PATENT DOCUMENTS 4,099,861 7/1978 Abel ..... 355/296 X 4,967,238 10/1990 Bares et al. ..... 355/296

5,081,505 1/1992 Ziegelmuller et al. ..... 355/299

5,111,251 5/1992 Uno et al. ..... 355/297

5,229,817 7/1993 Lange et al. ..... 355/296 X

FOREIGN PATENT DOCUMENTS 4-213487 8/1992 Japan .

4-214586 8/1992 Japan .

*Primary Examiner*—Fred L. Braun

*Assistant Examiner*—Shuk Y. Lee

*Attorney, Agent, or Firm*—T. L. Fair

[57] ABSTRACT

An apparatus which cleans a moving imaging surface with a cleaning blade and automatically detects a failure of the cleaning blade. A failure sensing mechanism detects the cleaning blade failure and activates a blade indexing mechanism. The indexing mechanism removes the failed cleaning blade and positions a new cleaning blade in a wiping or doctoring mode frictional contact with the imaging surface for cleaning. A brush positioned upstream of the cleaning blade, in the direction of movement of the imaging surface, disturbs the particles thereon.

12 Claims, 4 Drawing Sheets

92
109
130
112
10
19
110
18
120
115
AXIAL AIR FLOW THROUGH HOUSING
150
101
100
17
12
172
170
180
140
160
ACTIVATE SOLENOID FOR BLADE INDEXING
DRIVE/POSITIONING CONTROL
SENSOR OUTPUT
CLEANING FAILURE SENSOR LOGIC
200
P/R SEAM LOCATION
MACHINE LOGIC
DEV. FOR BLADE INITIATION
INDEX SIGNAL
BLADE INDEXING LOGIC
210

HIGH RELIABILITY BLADE CLEANER SYSTEM

BACKGROUND OF THE INVENTION

This invention relates generally to an electrostatographic printer machine, and more particularly concerns a cleaning apparatus.

Blade cleaners have long been attractive because of their low cost, simplicity and ability to clean most contaminate materials from the photoreceptor. The major drawback to blade cleaners has been the randomness of their failures. The Weibull characteristics (where Weibull characteristics are the distribution of failure probabilities defined by the equation:

$$P(N)=(1-e)^{-((N-N_o)/N_a)^b}$$

where P(N)=cumulative failure probability at life N, $$\left.\begin{array}{l} N = \text{life parameters} \\ N_a = \text{characteristic life} \\ N_o = \text{minimum life} \\ b = \text{Weibull slope)} \end{array}\right\} \text{Weibull Characteristics)}$$

for the failure of a blade have been estimated as a characteristic life of 648Kc (Kc:K=1000 and c=copies or prints), and no minimum life (no life below which failures are not expected, i.e failures can occur from the start of use) and a slope of 1.2 (where a slope of 1 indicates random failure and a 3.57 slope indicates a normal distribution for determinable failure). These values yield a $B_5$ life of 50 Kc and a $B_{50}$ life of 458Kc. ($B_5$ life is where 5% of total population of blades have failed and $B_{50}$ life is where 50% of the total population of blades has failed.) These Weibull statistic values are for a single blade cleaning system. In low volume machines the blade cleaner has been the cleaner of choice because of it's low cost. The random failure mode has been tolerated because of the low monthly copy volume. Blades have been used in mid volume machines but the random failure mode has been troublesome. Since blade failure is random, no meaningful preventative replacement interval can be determined. High volume machines have not utilized cleaning blades as a viable option because of the random failure mode problem.

Several methods for sensing cleaning failures have been attempted. Some of these methods are based on an optical system which observes toner on the photoreceptor after the photoreceptor has been cleaned. Other methods include attempting to detect deterioration of the blade cleaning edge. And, at least one copier utilizes a diagnostic routine which generates a stress cleaning condition at the infrared densitometer (IRD) location and then looks at the photoreceptor, after cleaning, for a failure. (IRD is an optical device which measures infrared reflection from a toner patch on the photoreceptor. The amount of infrared absorbed or scattered indicates density of toner patch.) However, in each of the aforementioned methods, when a failure occurs, manual replacement (i.e. by a technical representative) of the cleaning blade is required. Many technical representatives also use their own stress test for blade cleaners. They look for streaks on the first white copy after dark dustings have been sent into the cleaner.

It has been found that the use of a preclean toner charging device can decrease the cleaning stress to a blade cleaner. For some types of toners, especially color toners, this preclean treatment may be necessary to obtain acceptable cleaning at reasonable blade loads.

The following disclosures may be relevant to various aspects of the present invention and may be briefly summarized as follows:

U.S. Pat. No. 5,081,505 to Ziegelmuller et al. discloses a rotatable wiper blade roller for cleaning residual toner particles from an image-bearing surface that includes a plurality of indexable wiper blades. The blades engage the image-bearing surface at an angle of 60° to 85° defined in the direction of particle removal by the cleaning edge of each such blade and image-bearing surface. The blades are cleaned secondarily by an intermittently rotatable fur brush that is completely out of contact with the image-bearing surface.

U.S. Pat. No. 4,967,238 to Bares et al. discloses an arrangement for detecting toner or debris deposits on an imaging surface arranged downstream from the cleaning station. The imaging surface is illuminated by a light source, a light intensity detecting sensor arrangement is provided to view the illuminated surface and produce a signal representative of detected light intensity, and a response signal is produced indicative of the condition of the imaging surface.

SUMMARY OF INVENTION

Briefly stated, and in accordance with one aspect of the present invention, there is provided an apparatus for cleaning a moving imaging surface having particles thereon, comprising a blade assembly including a plurality of cleaning blades with one of the cleaning blades frictionally contacting the imaging surface to remove particles therefrom. Means are provided for detecting a failure of the cleaning blade in contact with the imaging surface to remove a selected quantity of particles therefrom. Means index the blade assembly to position another one of the cleaning blades in frictional contact with the imaging surface and to space the first mentioned cleaning blade remotely from the imaging surface in response to the detecting means detecting the failure of the first mentioned cleaning blade.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 8:
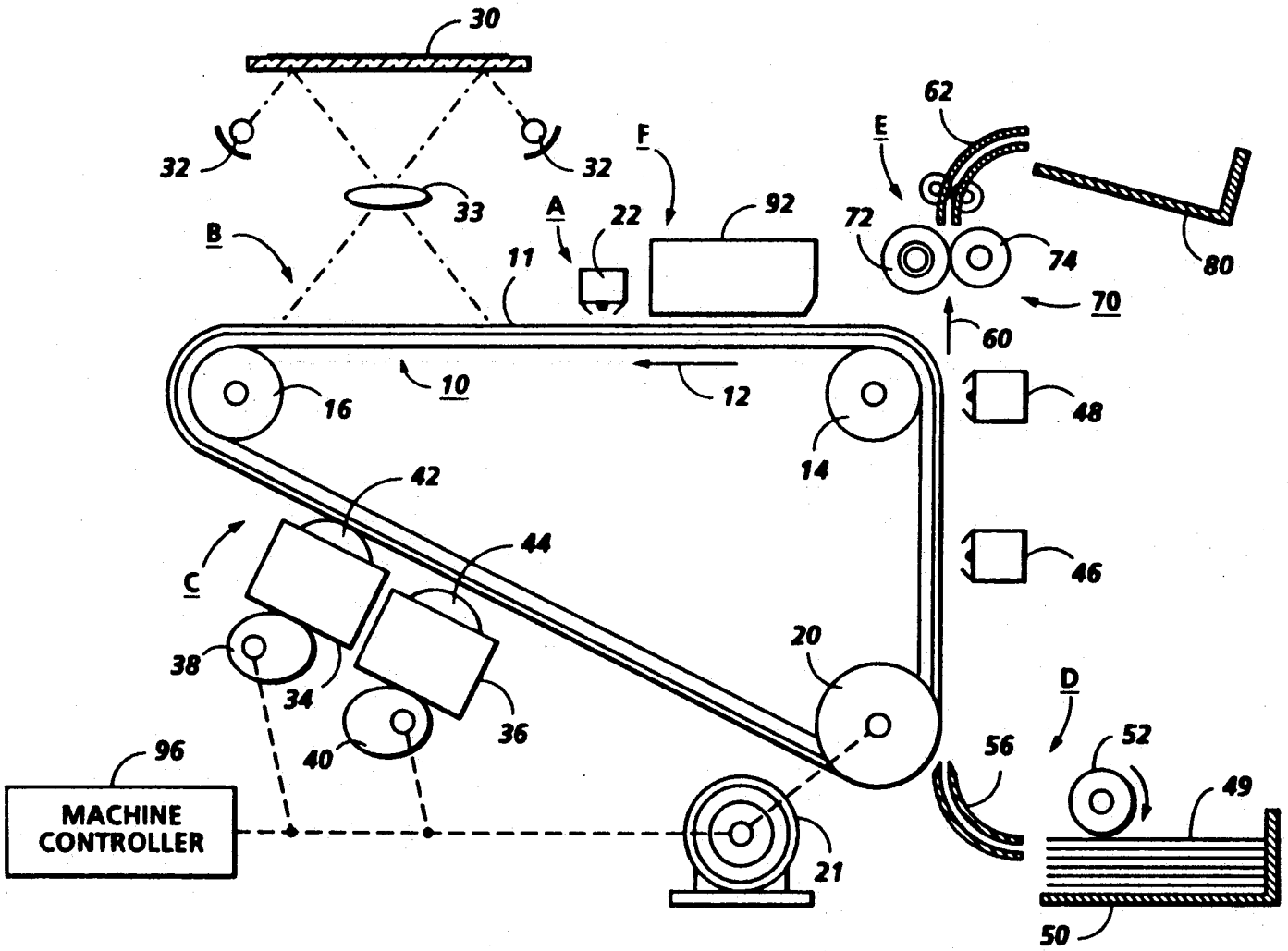
FIG. 8 is a schematic elevational view depicting an electrophotographic printing machine incorporating the features of the present invention therein.

For a general understanding of an electrophotographic printing machine in which the present invention may be incorporated, reference is made to FIG. 8 which depicts schematically the various components thereof. Hereinafter, like reference numerals will be employed throughout to designate identical elements, Although the hybrid cleaning apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 8 will be described briefly hereinafter. It will no doubt be appreciated that the various processing elements also find advantageous use in electrophotographic printing applications from an electronically stored original, and with appropriate modifications, to an ion projection device which deposits ions In image configuration on a charge retentive surface.

A reproduction machine, in which the present invention finds advantageous use, has a photoreceptor belt 10, having a photoconductive (or imaging) surface I 1. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 8, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14. Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The hybrid cleaner of the present invention is represented by the reference numeral 92. (See FIG. 1 for a detailed view of the hybrid cleaning apparatus.) Removed residual particles may also be stored for disposal.

A machine controller 96 is preferably a known programmable controller or combination of controllers, which conventionally control all the machine steps and functions described above. The controller 96 Is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. I through 7 where the showings are for the purpose of illustrating a preferred embodiment of the invention and not for limiting same.

Figure 1:
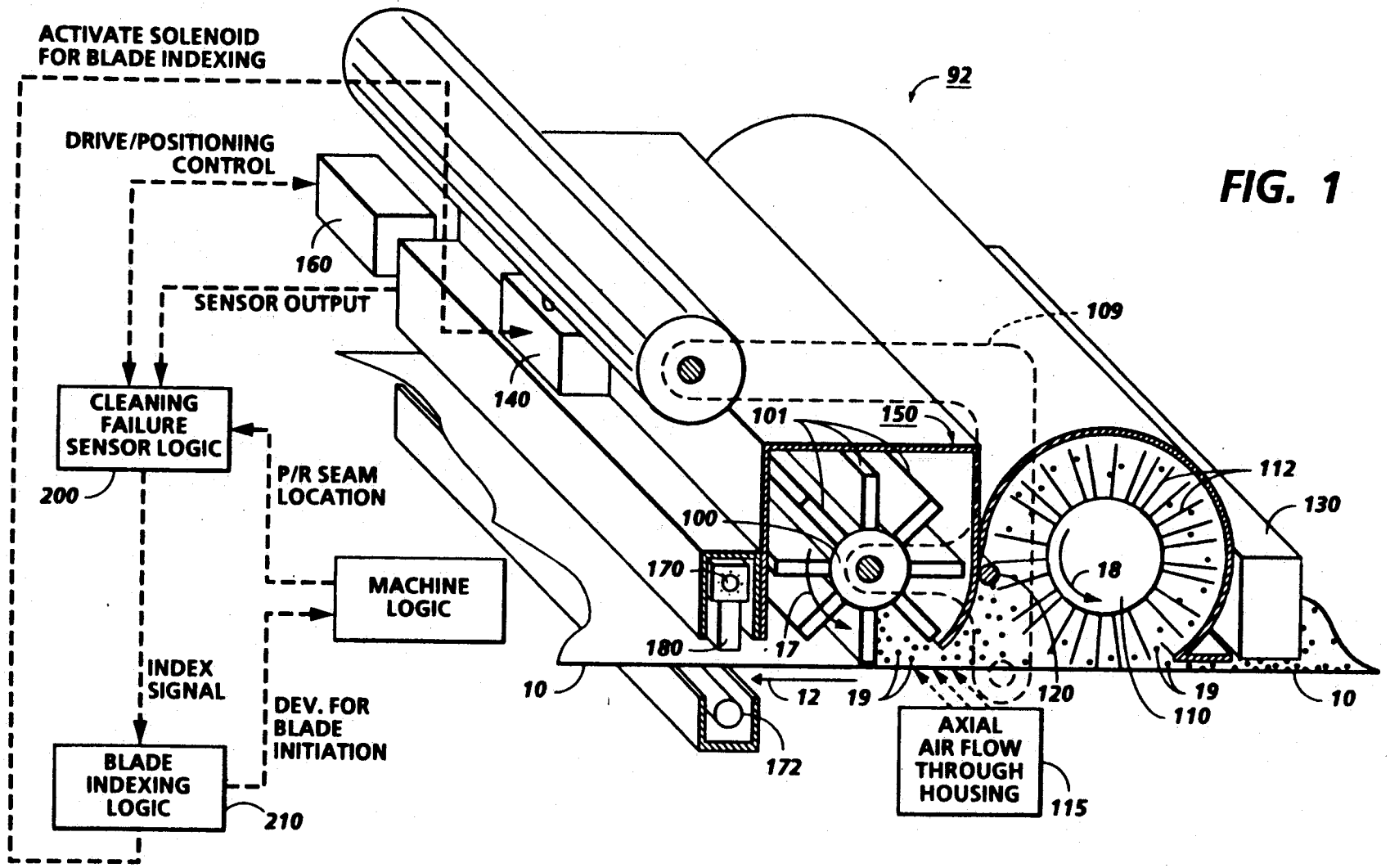
FIG. 1 is a schematic of the high reliability multiple blade cleaner system with failure detection and automatic blade indexing.

Referring now to FIG. 1 which shows a multiple blade hybrid cleaner with failure detection and automatic blade indexing. The cleaning blades 101, in a wiper mode, contact the imaging surface of the photoreceptor belt 10. The wiper mode is so named because of the wiping motion and wiping contact made with the imaging surface by the cleaning blades 101 to remove the residual particles 19 (e.g. toner, fibers, contaminants). FIG. 1 shows the multiple blade assembly 100, that rotates in the direction of arrow 17, containing eight cleaning blades 101. (At least two blades 101 are required for the multiple blade assembly 100). A disturber brush 110 is situated ahead of the multiple blade assembly 100 relative to the direction of movement of belt 10, as indicated by arrow 12. The reliability of the blade cleaner is improved by adding a brush upstream of the cleaning edge of the blade 101. The brush 1 10 acts as a disturber of the toner 19 and performs some of the toner cleaning. By disturbing the toner 19, high input masses of toner, which create a stress cleaning condition for the blade, are reduced in density. The mechanical cleaning action of the brush 110 also reduces the cleaning load on the blade. This reduction in cleaning load can allow for acceptable performance at a reduced blade force thus, reducing blade wear and increases blade life. The brush 110 also removes some of the contaminants 19 approaching the blade edge which can cause failures. The most common contaminants 19 are paper fibers which can lodge under and lift the blade edge causing toner to leak under the blade. The addition of a brush ahead of the cleaning blade is referred to as a hybrid (i.e. blade-brush) cleaner. The Weibull statistics for a hybrid cleaner with eight blades have been estimated to have a characteristic life of 4336Kc, no minimum life and a slope of 5.8. These values result in a $B_5$ life of 2575Kc and a $B_{50}$ life of 477OKc. The disturber brush fibers 112 contact a flicker bar 120, during rotation of the brush 110 in the direction of arrow 18, to promote the flicking action of the brush fibers 112. This flicking action, of the brush fibers 112, cleans debris and contaminants picked up by the brush 110. Other features of the multiple blade hybrid cleaner include a preclean charging device 130, and a blade indexing solenoid 140. The preclean charging device 130 is optional. It can be used for higher reliability, longer life or, if required, to allow for cleaning of the type of toner being used.

Figure 3:
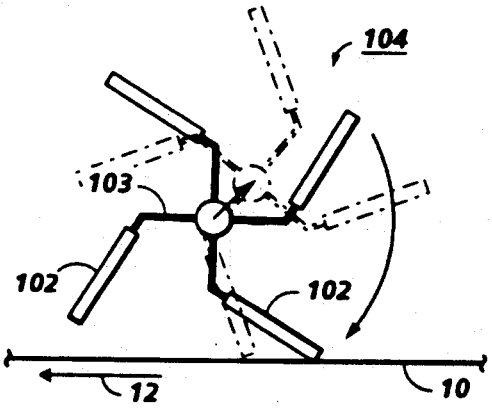
FIG. 3 is a schematic of a multiple blade assembly having doctor blades.

With continued reference to FIG. 1, a multiple blade assembly 100 allows one of the blades 101 to be positioned, in a wiping mode, with the cleaning edge in frictional contact with the photoreceptor. A wiper mode blade cleaner allows a large number of blades 101 to be used in the multiple blade assembly 100 and to reduce the blade's susceptibility to blade foldover at new blade startup. The reasons being that wiper blades generally require blade loads a little higher than doctor mode blade cleaners, yet they clean well. (Doctor mode blades use a chiseling motion rather than the wiping motion of the wiper mode blade.) Another advantage in using the wiper mode is that the blade startup, or blade initiation, against the photoreceptor's less likely to cause blade damage. A doctor blade edge will be torn apart, if it is run without toner against a photoreceptor, due to a lack of lubrication. Under these conditions, wiper blades deflect so that the blade forces decrease and no blade damage occurs. However, while the wiper mode has advantages over the doctoring mode in a multiple blade assembly, with some blade holder modifications, a multiple blade assembly having doctoring blades can also be created as shown in FIG. 3.

With continued reference to FIG. 1, the toner is removed from the cleaning area by a toner removal vacuum 115. The vacuum 115 is an axial airflow through the multiple blade assembly housing. The use of the vacuum toner removal allows a large number of blades 101 in the multiple blade assembly 100 and allows the use of the blade cleaner in any orientation. Airflow removes the need to rely on gravity to transport toner away from the blade tip and then down into an auger. The use of air flow to remove toner from the blade tip allows the use of the cleaner at the 3 o'clock, 6 o'clock, 9 o'clock and 12 o'clock cleaning positions. However, if air is not used, significant toner accumulation would occur at the blade tip, due to an insufficient blade angle necessary to move toner down the blade. In a no air system, steeper blade angles are achievable only with fewer blades limiting the cleaning positions to 6 o'clock and 9 o'clock. The blade indexing mechanism 150 moves an unused blade on the multiple blade assembly 100 into position on the photoreceptor 10 after a blade failure has been detected by the scanning sensor 170 that is powered by a drive motor 160. The cleaning failure sensor logic 200 determines from the failure sensor 180 output signals whether a blade cleaning failure has occurred (i.e. the failure sensor 180 must distinguish between blade failure toner streaks and photoreceptor scratches, etc.). An extended lamp 172 placed below the photoreceptor 10 allows detection of toner streaks. The blade indexing logic 210 coordinates the indexing of unused blades and the initiation of the new blade edge against the photoreceptor 10 (which includes a dark dusting patch for initial blade lubrication) and signaling when the multiple blade assembly 100 should be changed by the technical representative on the last new blade rotation. The present Invention incorporates a blade assembly that requires replacement by a technical representative (or the like) after the last blade reaches it's $B_5$ life. All of the blades prior to the last blade run to failure, which usually averages about a $B_{50}$ life. Other methods of replacing blade assembly units are possible with trade-offs between reliability and parts/service costs. A preclean toner charging device 130 adjusts the charge of toner entering the cleaner for easier removal of toners, especially color toners. (This feature may be optional depending on the cleaning characteristics of the toners).

Figure 2:
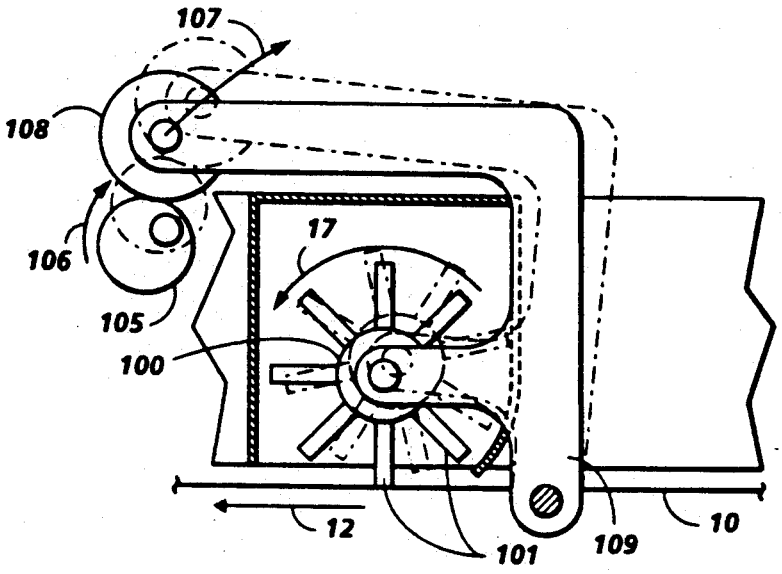
FIG. 2 is a schematic of the camming action of the multiple blade assembly.

Referring now to FIG. 2, the camming motion of the multiple blade assembly 100 is shown. The random blade cleaner failure mode can be reduced by allowing easy replacement of the cleaning blades. This is done by mounting several blades within the cleaner housing so that a new, unused blade can be indexed into operating position against the photoreceptor belt 10 when a failure occurs. The best method for performing this operation is to mount the blades radially on a central core and rotate, in the direction of arrow 17, the core to index a new blade into position. The camming action of the blade assembly 100 is indicated by the phantom lines in FIG. 2 and the indexing motion is explained in the following paragraph. The indexing of blades, whether manually accomplished or automatically indexed, is initiated by the detection of toner streaking on the imaging surface, after cleaning, which causes copy quality defects that are objectionable to the customer. The present invention detects the streaking prior to causing copy quality defects. The sensors of the present invention detect fine lines (i.e. ~70 um. in size) of toner which are too fine to show on copies. However, this a function of the developer scavenging and transfer and may or may not hold for all systems.

With continued reference to FIG. 2, the cam 105 rotates one-half a revolution in direction 106 to rotate the failed blade 101 out of contact position with the photoreceptor 10. The cam's 105 rotation causes the support arm 109 to be raised by moving the support arm 109 in the direction of arrow 107. This movement of the motion arm 109 withdraws the failed cleaning blade 101 from the imaging surface of the photoreceptor 10 moving in the direction of arrow 12. The motion of the arm 109 also engages the blade assembly 100 with a pawl (not shown) which indexes the blade assembly 100 by rotating the used blade out of a detent and dropping the new blade into the detent. The cam 105 then, rotates another one-half revolution to position a new blade 101 for wiping mode contact with the photoreceptor 10. This one-half rotation of the cam 105 causes the motion arm 109 to be lowered such that the new blade 1 01 frictionally engages the imaging surface of the photoreceptor 10, in the wiping mode for cleaning.

Referring now to FIG. 3 which shows a four blade holder with doctor blades (102) rather than wiper blades as shown in FIG. 2. The holder arms 103 can be manufactured as an aluminum or plastic extrusion or plastic molding with the individual blades 102 assembled onto the ends of the arms 103. The multiple doctor blade holder 104 is limited in the number of blades which it can use. For example, if the four blade holder shown in FIG. 3 were to be increased to an eight blade holder, the extra blades, inserted behind each of the four existing blades would cause interference by the blade in use against the flat plane of the photoreceptor shown. Point A in FIG. 3 shows the location of the undeflected eighth blade. (The doctor blade assembly 104 operates in the same camming manner as the wiper blade assembly described above in FIG. 2.)

Figure 4:
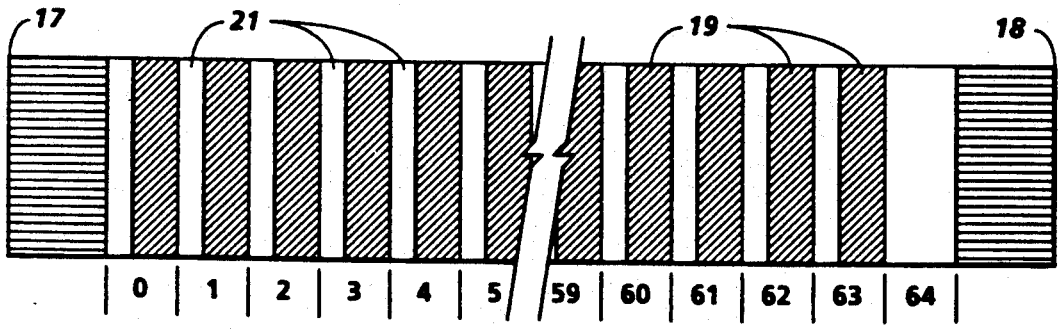
FIG. 4 is a schematic of the address strips, in one configuration, for failure detection.

Referring now to FIG. 4 which shows an example of the failure detection address strips 19, 2 1 thereon. The inboard side 17 and outboard side 18 of the photoreceptor are indicated to the sensing mechanism by differing widths of the address strips white areas 21 on the opposing ends of the photoreceptor 10. FIG. 4 shows eleven address strips 19, 21. However, the number of address strips 19, 21 can vary.

With continued reference to FIG. 4, the failure sensor detector 180 (shown in FIG. 1) is able to determine in what address strip 19, 21 the failure has occurred in. In order to confirm the presence of a toner streak in the same address strip 19, 21, the toner streak must be detected on two or more consecutive scans of the photoreceptor. The numbered chart at the bottom of FIG. 4 indicates the number of address locations which ideally is an even number between 16 and 64. The accuracy of the failure sensor 180 is increased as the number of address locations increase because the sensor can more accurately determine the address location of the failure. The address strip can be made within a transparent substrate (i.e. Mylar , . . . ) having black (opaque) regions or the address strip can be an aluminum strip with teeth type figures cut therein, near the scanner. The address strip in either case 's stretched 17 to outboard 18.

Figure 5:
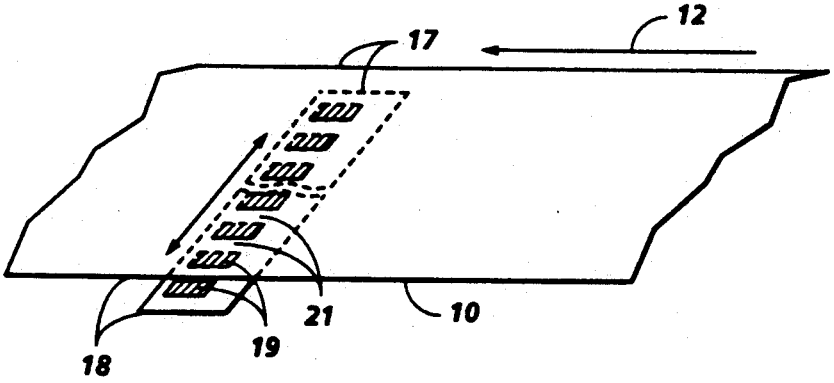
FIG. 5 is a schematic of the address strips and the photoreceptor.

Referring now to FIG. 5 which shows the photoreceptor 10 and the direction 12 of movement of the photoreceptor 10 past the stationary address strips 19, 21. Essential to the task of confirming that a failure has occurred is the information regarding the location of the streak along the width of the photoreceptor 10 (i.e. 8 cm from the inboard end 17). This information is provided by the addressing subsystem. This subsystem consists of an address strip 19, 21 and an optoelectronic device for reading the address strip 19, 21. In the simplest implementation of the scheme, the address strip consists of a series of alternating black 19 and white 21 patterns. Toner black and white patterns are produced photographically or lithographically. The address strip 19, 21 is stretched across and spaced from the photoreceptor 10. An optoelectronic device (similar to the one used to detect toner streaks), mounted on the toner streak detection scanner, monitors the address strip 19, 21. The optoelectronic device consists of a phototransistor, associated collimating optics (slits or lens) and a light source. In a typical implementation, the phototransistor monitors the amount of light reflected by the imaging surface. Since the imaging surface is highly reflective, the amount of light reflected is high. The presence of a toner streak on the imaging surface reduces the amount of light reflected. Hence, monitoring the output of the phototransistor would indicate the presence or absence of toner streaks.

Continued reference is made to FIG. 5. By electronically counting the number of black/white pairs 19, 21 encountered while the toner streak detector scans the photoreceptor 10 for signs of blade failures, it is possible to determine the location of a toner streak on the photoreceptor 10. On subsequent scans, the subsystem looks for a failure in the same location as in the previous scans. If a failure is found at the same location on two or more scans, the subsystem records this as a confirmed failure and initiates necessary corrective actions.

Figure 6:
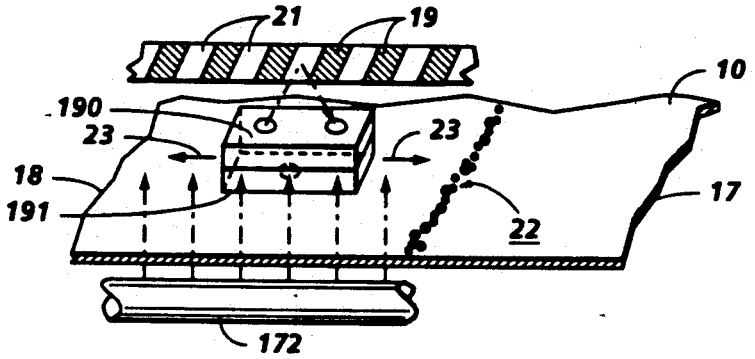
FIG. 6 is a schematic of the failure sensor detection of toner streaking on the photoreceptor using transmission.

FIG. 6 shows a schematic of the failure (toner streak) detector 190 operating in the transmission mode (which is the preferred mode) of operation. An extended source of light placed below the photoreceptor 10 provides the light for detecting toner streaks. This source of light is a simple incandescent lamp 172 with a diffuser to provide a uniform light intensity. A photodetector 191 mounted on a scanning assembly monitors the light intensity transmitted through the photoreceptor 10. When the scanning assembly passes over a toner streak, the photodetector 191 registers a decrease in the light intensity transmitted through the photoreceptor 10. The exact location of the toner streak 22 is recorded by the address sensor. If the system registers a decreased light intensity, on a subsequent scan, at the same location on the photoreceptor 10, it is considered an indicator of a failed cleaning blade. The blade indexing mechanism 150 (see FIG. 1) is then activated to remove the failed blade from contact with the photoreceptor 10 and rotate the next unused blade 101, see FIG. 2 (or 102, see FIG. 3) in the multiple blade assembly into a wiping (or doctoring) mode contact position with the imaging surface of the photoreceptor 10.

Figure 7:
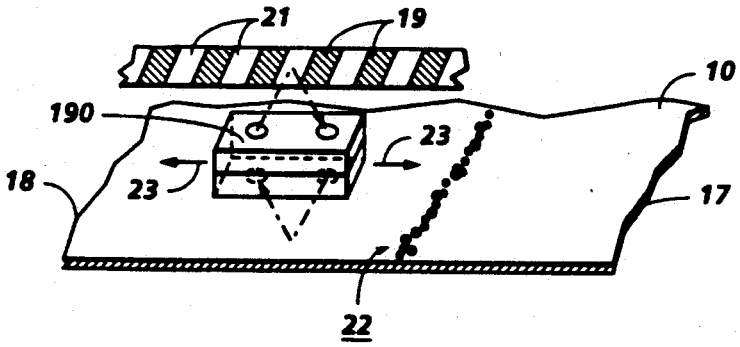
FIG. 7 is a schematic of the failure sensor detection of toner streaking on the photoreceptor using reflection.

Referring now to FIG. 7 which shows a schematic of the failure sensor detector 190 of toner streaking on the photoreceptor 10. The figure shows a toner streak 22, oriented in the process direction. As the sensor 180 [having LEDs (i.e., light emitting diodes) and photodetectors] scans back and forth in the directions indicated by arrow 23 across the photoreceptor 10, reflection from the photoreceptor 10 is taken. As long as the scanner reads a clear area It will continue scanning. However, when a dark area (caused by toner streaking 22) is scanned, the light is absorbed and scattered instead of reflected. Thus, the scanner then registers the address strip 19, 21 location of the toner streak 22 and scanning is then continued. If upon the second consecutive scan, a toner streak 22 occurs in the same address area 19, 21, the scanner returns to it's home position at the inboard 17 or outboard 18 location, and the blade is registered in the failure sensor logic 200 (see FIG. 1) as a failure. The blade indexing mechanism 150 (see FIG. 1) is then activated to remove the failed blade and rotate the next unused blade 101, see FIG. 2 (or 102, see FIG. 3), in the multiple blade assembly 100 into a wiping (or doctoring) mode contact position with the imaging surface of the photoreceptor 10.

In recapitulation, the apparatus for removing particles from the imaging surface in the present invention requires a disturber brush located ahead of the cleaning blade to remove contaminants and decrease the cleaning load to the blade (i.e. increasing the Weibull slope of failures to give a more predictable failure point) and increases the service life of the cleaner. The cleaning failure sensor detects the streaks of toner on the imaging surface after the cleaning blade has been used. The failure detection subsystem consisting of a toner streak sensor, streak location sensor, address strip, light sources and logic circuits scans the imaging surface for signs of blade failures. If a failure is found and confirmed, the subsystem signals the main processor (that controls the printer/copier) to stop the copy process and enter a maintenance mode. While in the maintenance mode, the failed blade is indexed out and a new blade is indexed into position. Necessary precautions like providing a light toner dusting on the photoreceptor before indexing in a new blade are taken. Once the new blade is installed and confirmed to operate without failures in the wiper mode, the subsystem signals the main processor to continue with the copy process. The subsystem also restarts the scanning of the imaging surface with an optoelectronic device to detect the presence of toner streaks. If another blade failure is detected and confirmed the indexing process is repeated. The last new blade on the multiple blade assembly is run to it's $B_5$ life and then the multiple blade assembly carousel must be manually replaced with another carousel containing new, unused blades.

It is, therefore, apparent that there has been provided in accordance with the present invention, a multiple blade hybrid cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for cleaning a moving imaging surface having particles thereon comprising:

a blade assembly, including a plurality of cleaning blades with one of the cleaning blades being in frictional contact with the imaging surface to remove particles therefrom;

means for detecting a failure of the cleaning blade in contact with the imaging surface to remove a selected quantity of particles therefrom, said detecting means including an address subsystem for defining a location of the imaging surface having a toner streak thereon; and means for indexing said blade assembly to position another one of the cleaning blades in frictional contact with the imaging surface and to space the first mentioned cleaning blade remotely from the imaging surface in response to said detecting means detecting the failure of the first mentioned cleaning blade.

2. An apparatus as recited in claim 1, further comprising a means for disturbing the particles on the moving imaging surface.

3. An apparatus as recited claim 2, wherein the imaging surface has a direction of movement and said blade assembly is positioned after said disturbing means in the direction of movement of the imaging surface.

4. An apparatus as recited in claim 3, wherein said disturbing means is chosen from a group consisting of a brush, a foam roll and a web.

5. An apparatus as recited in claim 1, wherein the imaging surface has a width, said address subsystem comprises:

an address strip, located below and spaced away from the imaging surface extending across the width of the imaging surface; and means for reading said address strip.

6. An apparatus as recited claim 5, wherein said reading means comprises:

a toner streak detection scanner; and an optoelectronic device mounted on said scanner.

7. An apparatus as recited in claim 6, wherein said scanner detects the toner streak on the imaging surface and defines the location of the toner streak on said address strip, said indexing means being activated, in response to the toner streak being detected, in at least two consecutive passes, at the same location on said address strip, to index said blade assembly to position another cleaning blade in frictional contact with the imaging surface.

8. An apparatus as recited in claim 7, wherein said indexing means, upon activation, rotates said blade assembly, said blade assembly being operator replaceable with an unused blade assembly when a predetermined blade life of a last blade in said blade assembly is reached.

9. An apparatus as recited claim 8, wherein said predetermined life of said last blade is a $B_5$ life.

10. An apparatus as recited in claim 1, wherein each of said plurality of cleaning blades is positioned against the imaging surface in a wiper mode position.

11. An apparatus as recited claim 1, wherein each of said plurality of cleaning blades is positioned against the imaging surface in a doctor mode position.

12. An apparatus as recited in claim 1, further comprising:

a housing for holding said blade assembly; and means for creating a reduced air pressure in said housing to provide axial air flow through said housing for removal of toner being cleaned from the imaging surface by said blade assembly.

* * * * *